US011355057B2

(12) United States Patent
Wu et al.

(10) Patent No.: US 11,355,057 B2
(45) **Date of Patent: *Jun. 7, 2022**

(54) SCAN-TYPE DISPLAY APPARATUS AND DRIVING DEVICE THEREOF

(71) Applicant: MACROBLOCK, INC., Hsinchu (TW)

(72) Inventors: Yi-Ta Wu, Hsinchu (TW); Chun-Yi Li, Hsinchu (TW); Hung-I Cheng, Hsinchu (TW); Ping-Kai Huang, Hsinchu (TW)

(73) Assignee: MACROBLOCK, INC., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/211,467

(22) Filed: Mar. 24, 2021

(65) Prior Publication Data

US 2021/0304668 A1 Sep. 30, 2021

(30) Foreign Application Priority Data

Mar. 26, 2020 (TW) ..... 109110131
Feb. 9, 2021 (TW) ..... 110104898

(51) Int. Cl.
*G09G 3/32* (2016.01)
*G09G 3/34* (2006.01)

(52) U.S. Cl.
CPC ..... *G09G 3/32* (2013.01); *G09G 3/3426* (2013.01); *G09G 2310/0278* (2013.01)

(58) Field of Classification Search
None
See application file for complete search history.

(56) References Cited

U.S. PATENT DOCUMENTS 6,057,820 A 5/2000 Irwin
8,120,599 B2 2/2012 Kang et al.
(Continued)

FOREIGN PATENT DOCUMENTS

CN 1573880 A 2/2005
CN 1797118 A 7/2006
(Continued)

OTHER PUBLICATIONS

Search Report appended to an Office Action, which was issued to Taiwanese counterpart application No. 109110131 by the TIPO dated Oct. 30, 2020 with an English translation thereof.
(Continued)

*Primary Examiner* — Matthew Yeung
(74) *Attorney, Agent, or Firm* — Akerman LLP; Peter A. Chiabotti

(57) ABSTRACT

A scan-type display apparatus includes a light emitting module, a display module, a control module and a driver module. The light emitting module includes an LED array having a common anode configuration. The control module generates an image stream, a plurality of switching signals that cause the LED array to emit light in a line scan manner, and an image refresh signal that is related to refreshing of images on a display constituted by the light emitting module and the display module. The driver module generates a drive output to drive the display module, such that the display shows images represented by the image stream and that the refreshing of images on the display is synchronous to the line scan.

11 Claims, 4 Drawing Sheets

(56) References Cited

U.S. PATENT DOCUMENTS

| | | | | |
|---|---|---|---|---|
| 10,395,586 | B2 | 8/2019 | Kim | |
| 2001/0022572 | A1 | 9/2001 | Murade | |
| 2003/0122773 | A1 | 7/2003 | Washio et al. | |
| 2003/0179221 | A1 | 9/2003 | Nitta et al. | |
| 2004/0207315 | A1* | 10/2004 | Robbie | H01L 27/3293 313/504 |
| 2005/0231449 | A1 | 10/2005 | Miyagawa | |
| 2009/0309855 | A1 | 12/2009 | Wang | |
| 2010/0110097 | A1* | 5/2010 | Nam | G09G 3/3648 345/589 |
| 2011/0141004 | A1 | 6/2011 | Kwon | |
| 2012/0188272 | A1 | 7/2012 | Wang et al. | |
| 2013/0114016 | A1 | 5/2013 | Lim et al. | |
| 2016/0012787 | A1 | 1/2016 | Takahashi et al. | |
| 2016/0063933 | A1 | 3/2016 | Kobayashi et al. | |
| 2016/0125800 | A1 | 5/2016 | Kim | |
| 2017/0038875 | A1 | 2/2017 | Lee | |
| 2018/0018924 | A1* | 1/2018 | Mao | G09G 3/3406 |
| 2018/0090080 | A1 | 3/2018 | Chen et al. | |
| 2018/0293927 | A1 | 10/2018 | Tang et al. | |
| 2019/0206329 | A1 | 7/2019 | Lee et al. | |
| 2019/0251914 | A1 | 8/2019 | Chen | |
| 2019/0362683 | A1 | 11/2019 | Ikeda et al. | |
| 2020/0090597 | A1 | 3/2020 | Chen et al. | |
| 2020/0090608 | A1 | 3/2020 | Calayir et al. | |
| 2021/0304668 | A1 | 9/2021 | Wu et al. | |
| 2021/0304690 | A1 | 9/2021 | Wu et al. | |

FOREIGN PATENT DOCUMENTS

| | | | |
|---|---|---|---|
| CN | 101154353 | A | 4/2008 |
| CN | 102148625 | A | 8/2011 |
| CN | 101436393 | B | 4/2012 |
| CN | 101202017 | B | 5/2012 |
| CN | 106652894 | B | 11/2018 |
| CN | 109192149 | A | 1/2019 |
| CN | 109523958 | A | 3/2019 |
| CN | 209070956 | U | 7/2019 |
| CN | 108550351 | B | 3/2020 |
| TW | 200846775 | A | 12/2008 |
| TW | I390490 | B | 3/2013 |
| TW | I393104 | B | 4/2013 |
| TW | I645392 | B | 12/2018 |
| TW | 201914360 | A | 4/2019 |
| TW | 201935454 | A | 9/2019 |
| TW | I672686 | B | 9/2019 |
| TW | I688945 | B | 3/2020 |

OTHER PUBLICATIONS

Search Report appended to an Office Action and English translation thereof, which was issued in corresponding Taiwanese application No. 109144111 by the TIPO dated Sep. 17, 2021 with an English translation thereof.

Search Report appended to an Office Action and English translation thereof, which was issued in corresponding Taiwanese application No. 110104896 by the TIPO dated Sep. 27, 2021 with an English translation thereof.

Search Report appended to an Office Action and English translation thereof, which was issued in corresponding Taiwanese application No. 110104898 by the TIPO dated Nov. 24, 2021 with an English translation thereof.

Search Report appended to an Office Action and English translation thereof, which was issued to Taiwanese counterpart application No. 110104899 by the TIPO dated Sep. 27, 2021 with an English translation thereof.

Search Report appended to an Office Action and English translation thereof, which was issued in corresponding Taiwanese application No. 110104901 by the TIPO dated Sep. 28, 2021 with an English translation thereof.

Office Action issued in corresponding U.S. Appl. No. 17/205,897 dated Dec. 20, 2021.

Office Action issued in corresponding U.S. Appl. No. 17/211,396 dated Nov. 12, 2021.

Office Action issued in corresponding U.S. Appl. No. 17/211,419 dated Sep. 3, 2021.

Office Action issued in corresponding U.S. Appl. No. 17/211,474 dated Aug. 6, 2021.

Office Action issued in corresponding U.S. Appl. No. 17/211,437 dated Aug. 5, 2021.

Office Action issued in corresponding U.S. Appl. No. 17/211,419 dated Mar. 17, 2022.

Office Action issued in corresponding U.S. Appl. No. 17/211,450 dated Jan. 27, 2022.

* cited by examiner

SCAN-TYPE DISPLAY APPARATUS AND DRIVING DEVICE THEREOF

CROSS-REFERENCE TO RELATED APPLICATION

This application claims priority of Taiwanese Patent Application Nos. 109110131 and 110104898, respectively filed on Mar. 26, 2020 and Feb. 9, 2021.

FIELD

The disclosure relates to displaying techniques, and more particularly to a scan-type display apparatus and a driving device thereof.

BACKGROUND

In a conventional scan-type display apparatus, a driving device for driving a display to show images includes a control module and a driver module. The driver module receives a synchronization control signal and an image stream from the control module. The image stream contains multiple pieces of image data that respectively correspond to multiple images or image frames to be shown by the display. The driver module drives the display based on the synchronization control signal and the image stream such that switching of a backlight module, which includes a light emitting diode (LED) array, of the display between a state where all LEDs are lit and a state where no LEDs are lit is related to the synchronization control signal, such that light emitted by the backlight module is modulated by a display module of the display to show the images or image frames represented by the image stream, and such that refreshing of images on the display is synchronous to the synchronization control signal. The synchronization control signal is a vertical synchronization signal, is periodic, and has a frequency of, for example, 60 Hz. Therefore, the display refreshes periodically, and a frame rate thereof is equal to the frequency of the synchronization control signal.

However, under a circumstance where the synchronization control signal is non-periodic and where the backlight module is a scanning backlight module that is triggered by the synchronization control signal and that emits light in a line scan manner, driving the display module in the aforesaid manner will result in image tearing or image interruption.

SUMMARY

Therefore, an object of the disclosure is to provide a scan-type display apparatus and a driving device thereof. The scan-type display apparatus can alleviate the drawback of the prior art.

According to an aspect of the disclosure, the scan-type display apparatus includes a light emitting module, a display module and a driving device. The light emitting module serves as a backlight module, is to receive an input voltage, and includes a light emitting diode (LED) array. The LED array has a common anode configuration, and includes a plurality of scan lines, a plurality of data lines, and a plurality of LEDs arranged in a matrix with a plurality of rows and a plurality of columns. With respect to each of the rows, anodes of the LEDs in the row are coupled to a respective one of the scan lines. With respect to each of the columns, cathodes of the LEDs in the column are coupled to a respective one of the data lines. The display module cooperates with the light emitting module to constitute a display. The driving device includes a control module and a driver module. The control module is coupled to the light emitting module, generates an image stream and a synchronization control signal, generates a plurality of switching signals and an image refresh signal based on the synchronization control signal, and outputs the switching signals to the light emitting module. The switching signals are generated in such a way that the light emitting module provides the input voltage to the scan lines sequentially without overlapping in time so as to drive the LEDs to emit light in a line scan manner. The image refresh signal is related to one of the switching signals that corresponds to a last line of the line scan in each line scan cycle. The driver module is coupled to the display module and the control module, and is to receive the image stream and the image refresh signal from the control module. The driver module generates a drive output based on the image stream and the image refresh signal and outputs the drive output to the display module, such that the display shows images represented by the image stream and that refreshing of images on the display is synchronous to the line scan.

According to another aspect of the disclosure, the driving device is adapted to be used in a scan-type display apparatus. The scan-type display apparatus includes a light emitting module and a display module that cooperatively constitute a display. The light emitting module serves as a backlight module, receives an input voltage, and includes a light emitting diode (LED) array that has a common anode configuration and that includes a plurality of scan lines. The driving device includes a control module and a driver module. The control module is adapted to be coupled to the light emitting module, generates an image stream and a synchronization control signal, generates a plurality of switching signals and an image refresh signal based on the synchronization control signal, and outputs the switching signals to the light emitting module. The switching signals are generated in such a way that the light emitting module provides the input voltage to the scan lines sequentially without overlapping in time so as to drive the LEDs to emit light in a line scan manner. The image refresh signal is related to one of the switching signals that corresponds to a last line of the line scan in each line scan cycle. The driver module is coupled to the control module to receive the image stream and the image refresh signal therefrom, and is adapted to be further coupled to the display module. The driver module generates a drive output based on the image stream and the image refresh signal and outputs the drive output to the display module, such that the display shows images represented by the image stream and that the refreshing of images on the display is synchronous to the line scan.

According to yet another aspect of the disclosure, the scan-type display apparatus includes a light emitting module and a driving device. The light emitting module serves as a display, is to receive an input voltage, and includes a light emitting diode (LED) array. The LED array has a common anode configuration, and includes a plurality of scan lines, a plurality of data lines, and a plurality of LEDs arranged in a matrix with a plurality of rows and a plurality of columns. With respect to each of the rows, anodes of the LEDs in the row are coupled to a respective one of the scan lines. With respect to each of the columns, cathodes of the LEDs in the column are coupled to a respective one of the data lines. The driving device includes a control module and a driver module. The control module is coupled to the light emitting module, generates an image stream and a synchronization control signal, generates a plurality of switching signals and an image refresh signal based on the synchronization control signal, and outputs the switching signals to the light emitting module. The switching signals are generated in such a way that the light emitting module provides the input voltage to the scan lines sequentially without overlapping in time so as to drive the LEDs to emit light in a line scan manner. The image refresh signal is related to one of the switching signals that corresponds to a last line of the line scan in each line scan cycle. The driver module is coupled to the data lines and the control module, and is to receive the image stream and the image refresh signal from the control module. The driver module generates a plurality of driving signals based on the image stream and the image refresh signal and outputs the driving signals respectively to the data lines, such that the light emitting module shows images represented by the image stream and that refreshing of images on the light emitting module is synchronous to the line scan.

According to still another aspect of the disclosure, the driving device is adapted to be used in a scan-type display apparatus that includes a light emitting module. The light emitting module serves as a display, receives an input voltage, and includes a light emitting diode (LED) array that has a common anode configuration and that includes a plurality of scan lines and a plurality of data lines. The driving device includes a control module and a driver module. The control module is adapted to be coupled to the light emitting module, generates an image stream and a synchronization control signal, generates a plurality of switching signals and an image refresh signal based on the synchronization control signal, and outputs the switching signals to the light emitting module. The switching signals are generated in such a way that the light emitting module provides the input voltage to the scan lines sequentially without overlapping in time so as to drive the LED array to emit light in a line scan manner. The image refresh signal is related to one of the switching signals that corresponds to a last line of the line scan in each line scan cycle. The driver module is coupled to the control module to receive the image stream and the image refresh signal therefrom, and is adapted to be further coupled to the data lines. The driver module generates a plurality of driving signals based on the image stream and the image refresh signal and outputs the driving signals respectively to the data lines, such that the light emitting module shows images represented by the image stream and that refreshing of images on the light emitting module is synchronous to the line scan.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
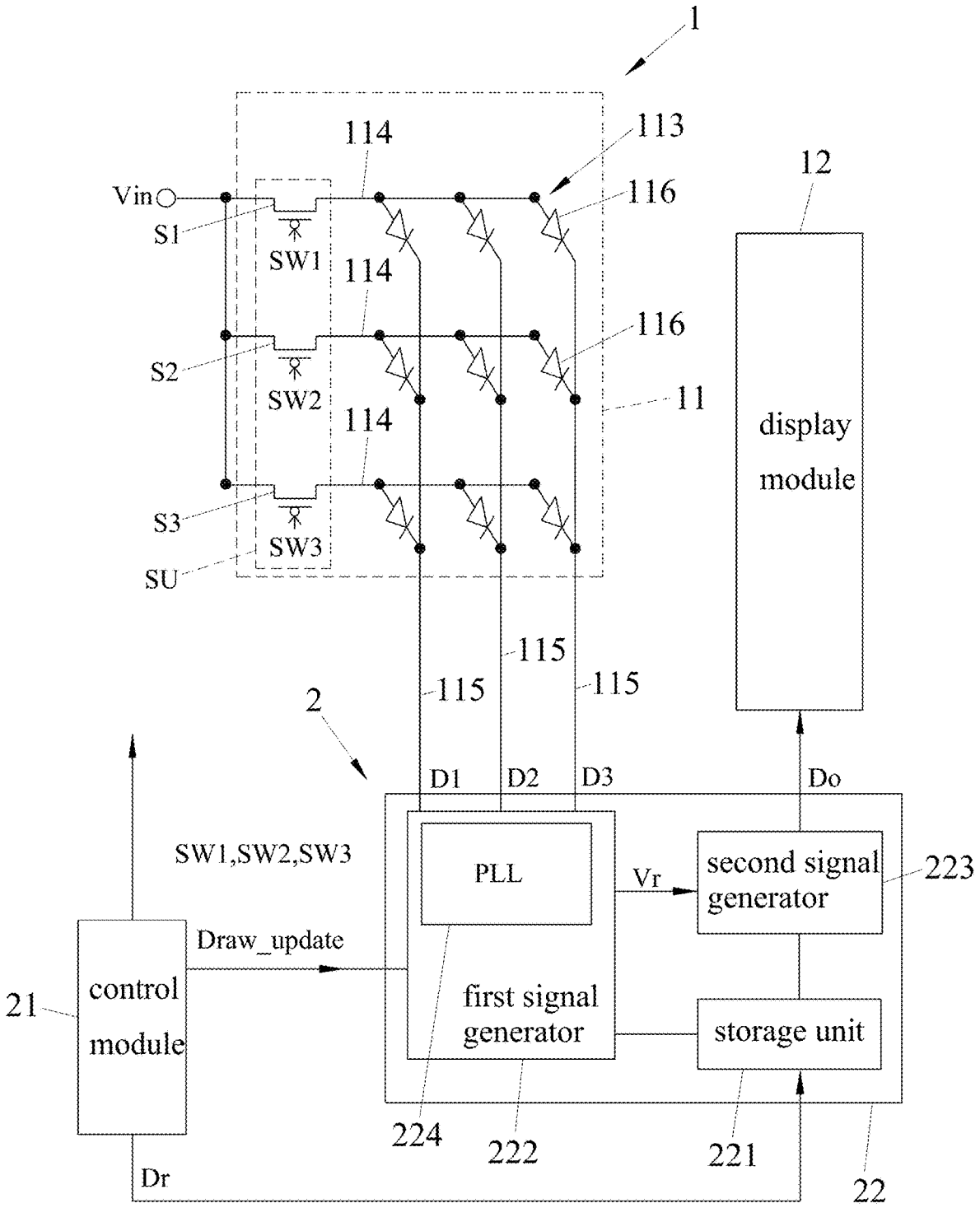
FIG. 1 is a circuit block diagram illustrating a first embodiment of a scan-type display apparatus according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
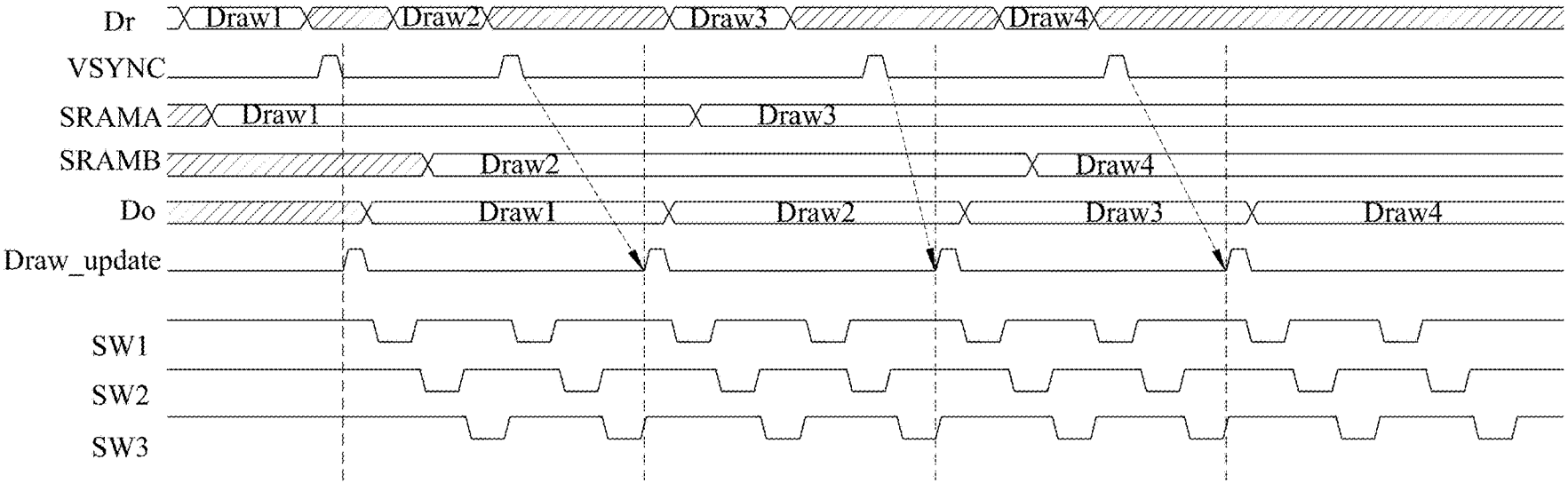
FIG. 2 is a timing diagram illustrating operations of the first embodiment.

Referring to FIGS. 1 and 2, a first embodiment of a scan-type display apparatus according to the disclosure is, for example, a liquid crystal display apparatus, supports dynamic frame rate technologies, and includes a light emitting module 11, a display module 12 and a driving device 2. The display module 12 is, for example, a liquid crystal panel, and cooperates with the light emitting module 11 to constitute a display 1 that is able to show images.

The light emitting module 11 serves as a backlight module, and includes a light emitting diode (LED) array 113 and a switch unit (SU).

The LED array 113 has a common anode configuration, and includes a plurality of scan lines 114, a plurality of data lines 115, and a plurality of LEDs 116 arranged in a matrix with a plurality of rows and a plurality of columns. With respect to each of the rows, anodes of the LEDs 116 in the row are coupled to a respective one of the scan lines 114. With respect to each of the columns, cathodes of the LEDs 116 in the column are coupled to a respective one of the data lines 115. For illustration purposes, the LED array 113 includes three scan lines 114, three data lines 115 and nine LEDs 116.

The switch unit (SU) includes a plurality of switches (e.g., three switches (S1-S3)). Each of the switches (S1-S3) (e.g., a P-type metal oxide semiconductor field effect transistor (pMOSFET)) has a first terminal (e.g., a source terminal) that is to receive an input voltage (Vin), a second terminal (e.g., a drain terminal) that is coupled to a respective one of the scan lines 114, and a control terminal (e.g., a gate terminal). Each of the switches (S1-S3), when conducting, permits transmission of the input voltage (Vin) therethrough to the respective one of the scan lines 114.

The driving device 2 includes a control module 21 and a driver module 22. The control module 21 is coupled to the control terminals of the switches (S1-S3). The driver module 22 includes a storage unit 221, a first signal generator 222 and a second signal generator 223. The storage unit 221 is coupled to the control module 21. The first signal generator 222 is coupled to the data lines 115, the control module 21 and the storage unit 221, and includes a phase-locked loop (PLL) 224. The second signal generator 223 is coupled to the display module 12, the storage unit 221 and the first signal generator 222. It should be noted that the second signal generator 223 includes a source driver and a gate driver, and is well known in the art, and therefore details thereof are omitted herein for the sake of brevity. It should also be noted that the switch unit (SU) and the driver module 22 are not fabricated on a single chip.

Figure 3:
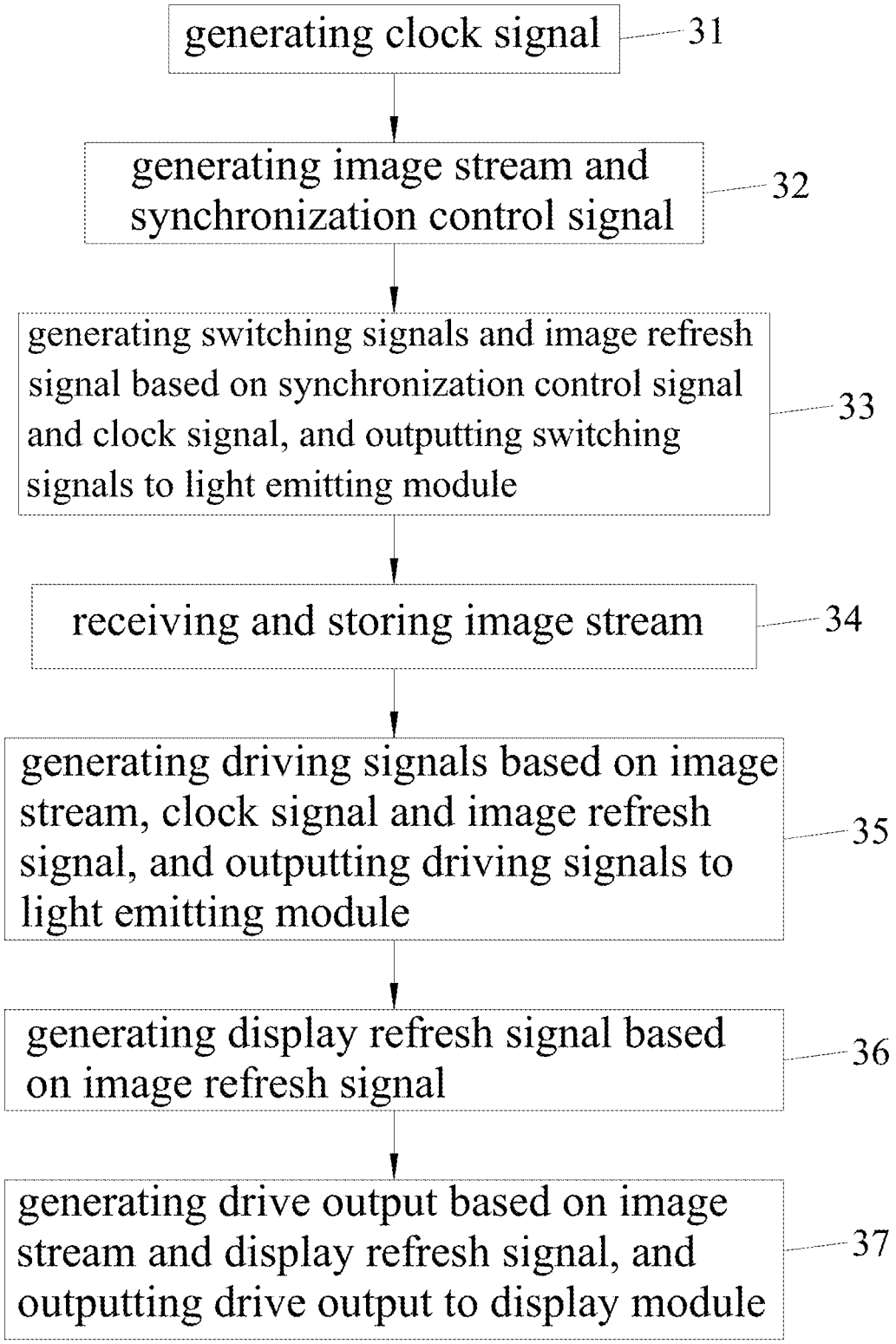
FIG. 3 is a flowchart illustrating a driving method performed by the first embodiment.

Referring to FIGS. 1 to 3, in this embodiment, a driving method performed by the driving device 2 to drive the display 1 to show images includes the following steps.

In step 31, the PLL 224 generates a first clock signal.

In step 32, the control module 21 generates an image stream (Dr) and a synchronization control signal (VSYNC). The image stream (Dr) contains multiple pieces of image data that respectively correspond to multiple images or image frames to be shown by the display 1. For illustration purposes, the image stream (Dr) exemplarily contains four pieces of image data (Draw1-Draw4). In this embodiment, the control module 21 includes a graphic processing unit (GPU) (not shown) that generates the pieces of image data (Draw1-Draw4) and that sequentially outputs the pieces of image data (Draw1-Draw4) to serve as the image stream (Dr).

In step 33, the control module 21 generates a plurality of switching signals (e.g., three switching signals (SW1-SW3)) and an image refresh signal (Draw_update) based on the synchronization control signal (VSYNC) and a second clock signal, and outputs the switching signals (SW1-SW3) respectively to the control terminals of the switches (S1-S3). The switching signals (SW1-SW3) are generated in such away that the LEDs 116 can emit light in a line scan manner. The image refresh signal (Draw_update) is related to one of the switching signals (SW1-SW3) that corresponds to a last line of the line scan in each line scan cycle (i.e., the switching signal (SW3)), and is further related to refreshing of images on the display 1 (i.e., an act of the display 1 switching from displaying a current image or image frame to displaying a next image or image frame).

In this embodiment, each of the synchronization control signal (VSYNC), the image refresh signal (Draw_update) and the switching signals (SW1-SW3) is a pulse signal. Each of the switching signals (SW1-SW3) has a pulse width that is a multiple of a period of the second clock signal. In each line scan cycle of the LEDs 116, the pulses of the switching signals (SW1-SW3) are staggered and non-overlapping in time (i.e., the pulse of the switching signal (SW1), the pulse of the switching signal (SW2) and the pulse of the switching signal (SW3) occur one by one without overlapping one another in time). Transition of the switching signals (SW1-SW3) is triggered by the first pulse of the image refresh signal (Draw_update). Each of the switches (S1-S3) conducts within each pulse of one of the switching signals (SW1-SW3) that is received thereby, and does not conduct outside the pulses of said one of the switching signals (SW1-SW3). Therefore, the switches (S1-S3) conduct one by one without overlapping in time, the input voltage (Vin) is outputted by the switch unit (SU) to the scan lines 114 sequentially without overlapping in time, and the LEDs 116 can emit light row by row without overlapping in time (i.e., the LEDs 116 can emit light in the line scan manner). Each pulse of the image refresh signal (Draw_update) lags a respective pulse of the synchronization control signal (VSYNC). A starting point of the first pulse of the image refresh signal (Draw_update) is substantially concurrent with an endpoint of the first pulse of the synchronization control signal (VSYNC). A starting point of each pulse of the image refresh signal (Draw_update), except the first pulse, is substantially concurrent with an end point of a pulse of said one of the switching signals (SW1-SW3) (i.e., the switching signal (SW3)) that occurs immediately after an end point of the respective pulse of the synchronization control signal (VSYNC).

It should be noted that each row of the LEDs 116 corresponds to a respective line of the line scan of the LEDs 116 (namely, a respective line of the LEDs 116 that emits light in each line scan cycle). It should also be noted that the control module 21 may generate the second clock signal, or may receive the first clock signal from the PLL 224 and take the first clock signal as the second clock signal.

In step 34, the storage unit 221 receives the image stream (Dr) from the control module 21, and stores the image stream (Dr). In this embodiment, the storage unit 221 includes two memories (SRAMA, SRAMB) that alternately store the pieces of image data (Draw1-Draw4) and that alternately output the pieces of image data (Draw1-Draw4) stored therein.

In step 35, the first signal generator 222 receives the image refresh signal (Draw_update) from the control module 21, and further receives the image stream (Dr) stored in the storage unit (221). The first signal generator 222 generates a plurality of driving signals (e.g., three driving signals (D1-D3)) based on the image stream (Dr), the first clock signal and the image refresh signal (Draw_update) and outputs the driving signals (D1-D3) respectively to the data lines 115, such that refreshing of backlight provided by the LEDs 116 is synchronous to the line scan. In this embodiment, each of the driving signals (D1-D3) is a pulse signal, and has a pulse width that is a multiple of the period of the first clock signal, and the multiple varies according to the image stream (Dr).

In step 36, the first signal generator 222 generates a display refresh signal (Vr) based on the image refresh signal (Draw_update). The display refresh signal (Vr) indicates starting points of at least some pulses of the driving signals (D1-D3).

In step 37, the second signal generator 223 receives the image stream (Dr) stored in the storage unit 221, and further receives the display refresh signal (Vr) from the first signal generator 222. The second signal generator 223 generates a drive output (Do) based on the image stream (Dr) and the display refresh signal (Vr) and outputs the drive output (Do) to the display module 12, such that the display 1 shows images or image frames represented by the image stream (Dr) and that the refreshing of images on the display 1 is synchronous to the refreshing of backlight provided by the LEDs 116 (i.e., the refreshing of images on the display 1 is synchronous to the line scan). In this embodiment, time points at which the drive output (Do) changes are substantially concurrent with the starting points of the corresponding pulses of each of the driving signals (D1-D3).

In this embodiment, for each of the LEDs 116, within any one of the pulses of the driving signal (D1/D2/D3) that is outputted to the data line 115 coupled to the LED 116, the LED 116 emits light when the switch (S1/S2/S3) that is coupled to the LED 116 conducts. In addition, light transmittance of the display module 12 varies according to the image stream (Dr), and light emitted by the LEDs 116 is modulated by the display module 12 to produce the images or image frames represented by the image stream (Dr).

In view of the above, the scan-type display apparatus of this embodiment has the following advantages.

1. Most of the LED arrays available on the market have the common anode configuration, and the driving device 2 can be used with the LED arrays having the common anode configuration.

2. Since the switching signals (SW1-SW3) are generated by the control module 21, and not the driver module 22, the driver module 22 has simpler digital timing design and less output pins as compared to an example where the switching signals are generated by the driver module.

3. Since the switch unit (SU) and the driver module 22 are not fabricated on a single chip, the driver module 22 can be designed to generate the switching signals further based on the total number of the switches of the switch unit (SU). Therefore, when the total number of the switches of the switch unit (SU) is increased to accommodate an increased total number of the LEDs 116 of the LED array 113, the driver module 22 can cooperate with at least one additional driver module 22 to generate the switching signals for controlling all the switches of the switch unit (SU). In addition, heat generated by the switch unit (SU) and the driver module 22 is not concentrated on a single chip, thereby alleviating heat dissipation problem of the scan-type display apparatus.

4. By virtue of the first signal generator 222 generating the display refresh signal (Vr) based on the image refresh signal (Draw_update), and by virtue of the second signal generator 223 generating the drive output (Do) based on the display refresh signal (Vr), the refreshing of images on the display 1 can occur when the line scan cycle of the LEDs 116 ends, thereby preventing image tearing or image interruption and attaining better display quality.

Figure 4:
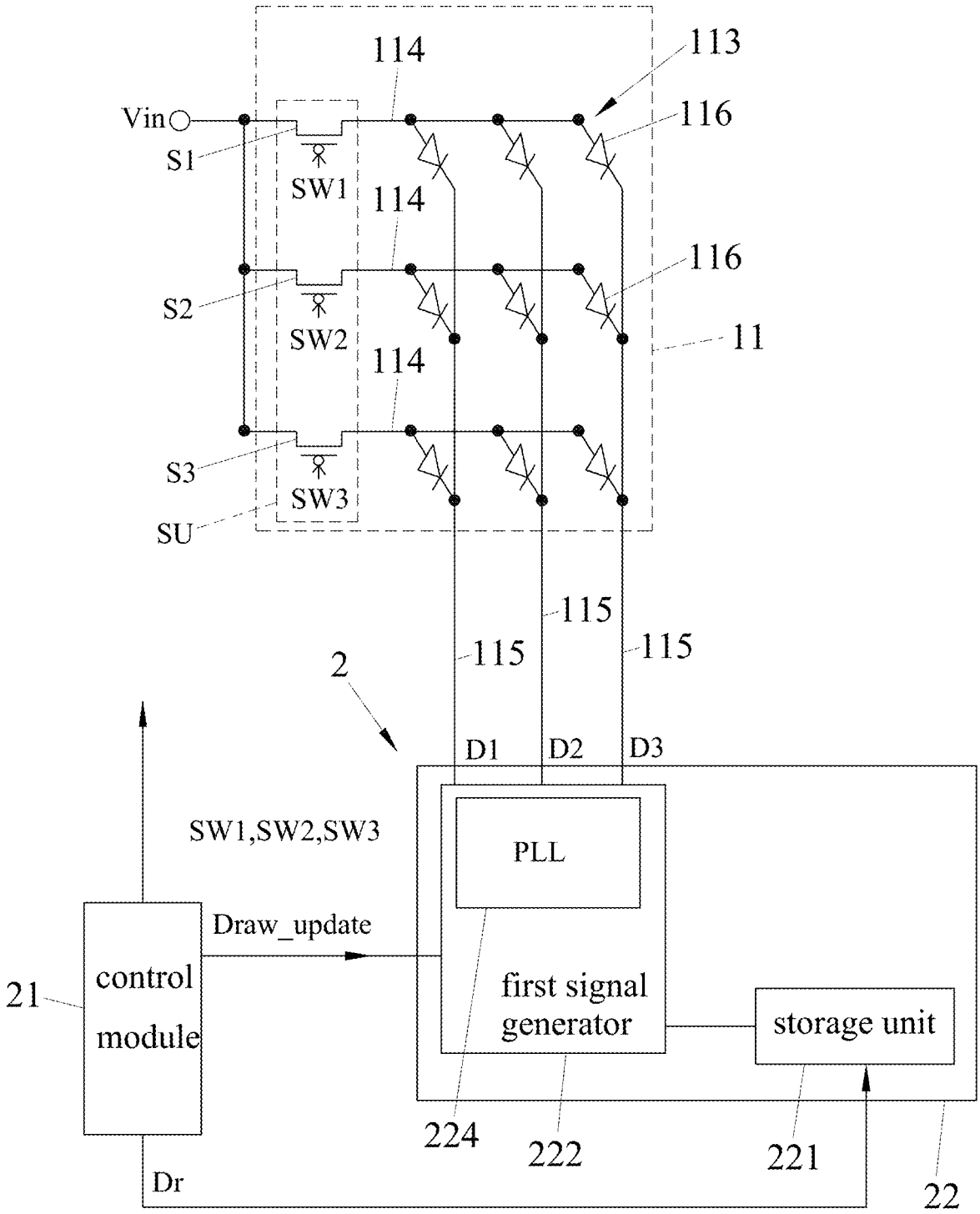
FIG. 4 is a circuit block diagram illustrating a second embodiment of the scan-type display apparatus according to the disclosure.

Referring to FIG. 4, a second embodiment of the scan-type display apparatus according to the disclosure is similar to the first embodiment, but differs from the first embodiment in that: (a) the display module 12 (see FIG. 1) and the second signal generator 223 (see FIG. 1) are omitted; (b) the light emitting module 11 serves as a display that is able to show images; and (c) the light emitting module 11 produces the images or image frames represented by the image stream (Dr), and refreshing of images on the light emitting array 11 occurs when the line scan cycle of the light emitting array 11 ends.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that the disclosure is not limited to the disclosed embodiments but is intended to cover various arrangements included within the spirit and scope of the broadest interpretation so as to encompass all such modifications and equivalent arrangements.

What is claimed is:

1. A scan-type display apparatus comprising:

a light emitting module serving as a backlight module, to receive an input voltage, and including a light emitting diode (LED) array; said LED array having a common anode configuration, and including a plurality of scan lines, a plurality of data lines, and a plurality of LEDs arranged in a matrix with a plurality of rows and a plurality of columns; with respect to each of said rows, anodes of said LEDs in said row being coupled to a respective one of said scan lines; with respect to each of said columns, cathodes of said LEDs in said column being coupled to a respective one of said data lines;

a display module cooperating with said light emitting module to constitute a display; and a driving device including a control module coupled to said light emitting module, generating an image stream and a synchronization control signal, generating a plurality of switching signals and an image refresh signal based on the synchronization control signal, and outputting the switching signals to said light emitting module, the switching signals being generated in such a way that said light emitting module provides the input voltage to said scan lines sequentially without overlapping in time so as to drive said LEDs to emit light in a line scan manner, the image refresh signal being related to one of the switching signals that corresponds to a last line of the line scan in each line scan cycle, and a driver module coupled to said display module and said control module, and to receive the image stream and the image refresh signal from said control module, said driver module generating a drive output based on the image stream and the image refresh signal and outputting the drive output to said display module, such that said display shows images represented by the image stream and that refreshing of images on said display is synchronous to the line scan.

2. The scan-type display apparatus of claim 1, wherein said driver module includes:

a storage unit coupled to said control module to receive the image stream therefrom, and storing the image stream;

a first signal generator coupled to said data lines, said control module and said storage unit, to receive the image refresh signal from said control module, and to further receive the image stream stored in said storage unit;

said first signal generator generating a plurality of driving signals based on the image refresh signal and the image stream, outputting the driving signals respectively to said data lines, and generating a display refresh signal based on the image refresh signal; and a second signal generator coupled to said display module, said storage unit and said first signal generator, to receive the image stream stored in said storage unit, and to further receive the display refresh signal from said first signal generator;

said second signal generator generating the drive output based on the image stream and the display refresh signal, and outputting the drive output to said display module.

3. The scan-type display apparatus of claim 2, wherein:

said first signal generator includes a phase-locked loop that generates a clock signal; and said first signal generator generates the driving signals further based on the clock signal.

4. The scan-type display apparatus of claim 1, wherein said light emitting module further includes:

a switch unit coupled to said control module and said scan lines, to receive the input voltage, to further receive the switching signals from said control module, and switching based on the switching signals to output the input voltage to said scan lines sequentially without overlapping in time.

5. The scan-type display apparatus of claim 4, wherein:

said switch unit includes a plurality of switches;

each of said switches has a first terminal that is to receive the input voltage, a second terminal that is coupled to a respective one of said scan lines, and a control terminal that is coupled to said control module to receive a respective one of the switching signals therefrom; and each of said switches, when conducting, permits transmission of the input voltage therethrough to the respective one of said scan lines.

6. A driving device adapted to be used in a scan-type display apparatus, the scan-type display apparatus including a light emitting module and a display module that cooperatively constitute a display, the light emitting module serving as a backlight module, receiving an input voltage, and including a light emitting diode (LED) array that has a common anode configuration and that includes a plurality of scan lines, said driving device comprising:

a control module adapted to be coupled to the light emitting module, generating an image stream and a synchronization control signal, generating a plurality of switching signals and an image refresh signal based on the synchronization control signal, and outputting the switching signals to the light emitting module, the switching signals being generated in such a way that the light emitting module provides the input voltage to the scan lines sequentially without overlapping in time so as to drive the LEDs to emit light in a line scan manner, the image refresh signal being related to one of the switching signals that corresponds to a last line of the line scan in each line scan cycle; and a driver module coupled to said control module to receive the image stream and the image refresh signal therefrom, and adapted to be further coupled to the display module;

said driver module generating a drive output based on the image stream and the image refresh signal and outputting the drive output to the display module, such that the display shows images represented by the image stream and that refreshing of images on the display is synchronous to the line scan.

7. The driving device of claim 6, wherein said driver module includes:

a storage unit coupled to said control module to receive the image stream therefrom, and storing the image stream;

a first signal generator coupled to said control module to receive the image refresh signal therefrom, further coupled to said storage unit to receive the image stream stored therein, and adapted to be further coupled to the data lines;

said first signal generator generating a plurality of driving signals based on the image refresh signal and the image stream, outputting the driving signals respectively to the data lines, and generating a display refresh signal based on the image refresh signal; and a second signal generator coupled to said storage unit to receive the image stream stored therein, further coupled to said first signal generator to receive the display refresh signal therefrom, and adapted to be further coupled to the display module;

said second signal generator generating the drive output based on the image stream and the display refresh signal, and outputting the drive output to the display module.

8. A scan-type display apparatus comprising:

a light emitting module serving as a display, to receive an input voltage, and including a light emitting diode (LED) array; said LED array having a common anode configuration, and including a plurality of scan lines, a plurality of data lines, and a plurality of LEDs arranged in a matrix with a plurality of rows and a plurality of columns; with respect to each of said rows, anodes of said LEDs in said row being coupled to a respective one of said scan lines; with respect to each of said columns, cathodes of said LEDs in said column being coupled to a respective one of said data lines; and a driving device including a control module coupled to said light emitting module, generating an image stream and a synchronization control signal, generating a plurality of switching signals and an image refresh signal based on the synchronization control signal, and outputting the switching signals to said light emitting module, the switching signals being generated in such a way that said light emitting module provides the input voltage to said scan lines sequentially without overlapping in time so as to drive said LEDs to emit light in a line scan manner, the image refresh signal being related to one of the switching signals that corresponds to a last line of the line scan in each line scan cycle, and a driver module coupled to said data lines and said control module, and to receive the image stream and the image refresh signal from said control module, said driver module generating a plurality of driving signals based on the image stream and the image refresh signal and outputting the driving signals respectively to said data lines, such that said light emitting module shows images represented by the image stream and that refreshing of images on said light emitting module is synchronous to the line scan.

9. The scan-type display apparatus of claim 8, wherein said light emitting module further includes:

a switch unit coupled to said scan lines and said control module, to receive the input voltage, to further receive the switching signals from said control module, and switching based on the switching signals to output the input voltage to said scan lines sequentially without overlapping in time.

10. The scan-type display apparatus of claim 8, wherein said driver module includes:

a storage unit coupled to said control module to receive the image stream therefrom, and storing the image stream; and a signal generator coupled to said data lines, said control module and said storage unit, to receive the image refresh signal from said control module, and to further receive the image stream stored in said storage unit;

said signal generator generating the driving signals based on the image stream and the image refresh signal, and outputting the driving signals respectively to said data lines.

11. A driving device adapted to be used in a scan-type display apparatus that includes a light emitting module, the light emitting module serving as a display, receiving an input voltage, and including a light emitting diode (LED) array that has a common anode configuration and that includes a plurality of scan lines and a plurality of data lines, said driving device comprising:

a control module adapted to be coupled to the light emitting module, generating an image stream and a synchronization control signal, generating a plurality of switching signals and an image refresh signal based on the synchronization control signal, and outputting the switching signals to the light emitting module, the switching signals being generated in such a way that the light emitting module provides the input voltage to the scan lines sequentially without overlapping in time so as to drive the LED array to emit light in a line scan manner, the image refresh signal being related to one of the switching signals that corresponds to a last line of the line scan in each line scan cycle; and a driver module coupled to said control module to receive the image stream and the image refresh signal therefrom, and adapted to be further coupled to the data lines;

said driver module generating a plurality of driving signals based on the image stream and the image refresh signal and outputting the driving signals respectively to the data lines, such that the light emitting module shows images represented by the image stream and that refreshing of images on the light emitting module is synchronous to the line scan.

* * * * *